US011342670B1

(12) United States Patent
Yang et al.

(10) Patent No.: US 11,342,670 B1
(45) Date of Patent: May 24, 2022

(54) ANTENNA STRUCTURE

(71) Applicant: Wistron Corp., New Taipei (TW)

(72) Inventors: Cheng-Chieh Yang, New Taipei (TW); Chih-Ming Chen, New Taipei (TW)

(73) Assignee: WISTRON CORP., New Taipei (TW)

( * ) Notice: Subject to any disclaimer, the term of this patent is extended or adjusted under 35 U.S.C. 154(b) by 32 days.

(21) Appl. No.: 17/137,270

(22) Filed: Dec. 29, 2020

(30) Foreign Application Priority Data

Nov. 20, 2020 (TW) ..... 109140713

(51) Int. Cl.
*H01Q 1/24* (2006.01)
*H01Q 5/371* (2015.01)
*H01Q 9/42* (2006.01)

(52) U.S. Cl.
CPC ..... *H01Q 5/371* (2015.01); *H01Q 1/243* (2013.01); *H01Q 9/42* (2013.01)

(58) Field of Classification Search
CPC ..... H01Q 9/42; H01Q 1/243; H01Q 5/371
See application file for complete search history.

(56) References Cited

FOREIGN PATENT DOCUMENTS

| | | | |
|---|---|---|---|
| CN | 103633436 | B | 6/2016 |
| TW | I638485 | B | 10/2018 |
| TW | I709280 | B | 11/2020 |

*Primary Examiner* — Graham P Smith

(57) ABSTRACT

An antenna structure includes a feeding radiation element, a first radiation element, a second radiation element, a nonconductive support element, and an accessory element. The feeding radiation element has a feeding point. The first radiation element includes a branch portion and a widening portion. The feeding radiation element is coupled through the first radiation element to a ground voltage. The second radiation element is coupled to the feeding radiation element and the first radiation element. The nonconductive support element carries the feeding radiation element, the first radiation element, and the second radiation element. The accessory element includes a nonconductive housing and an internal metal element. The branch portion and widening portion of the first radiation element are disposed on the nonconductive housing of the accessory element.

20 Claims, 7 Drawing Sheets

ANTENNA STRUCTURE

CROSS REFERENCE TO RELATED APPLICATIONS

This Application claims priority of Taiwan Patent Application No. 109140713 filed on Nov. 20, 2020, the entirety of which is incorporated by reference herein.

BACKGROUND OF THE INVENTION

Field of the Invention

The disclosure generally relates to an antenna structure, and more particularly, to a wideband antenna structure.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna for signal reception and transmission has insufficient bandwidth, it will degrade the communication quality of the relative mobile device. Accordingly, it has become a critical challenge for antenna designers to design a small-size, wideband antenna element.

BRIEF SUMMARY OF THE INVENTION

In an exemplary embodiment, the invention is directed to an antenna structure that includes a feeding radiation element, a first radiation element, a second radiation element, a nonconductive support element, and an accessory element. The feeding radiation element has a feeding point. The first radiation element includes a branch portion and a widening portion. The feeding radiation element is coupled through the first radiation element to a ground voltage. The second radiation element is coupled to the feeding radiation element and the first radiation element. The nonconductive support element carries the feeding radiation element, the first radiation element, and the second radiation element. The accessory element includes a nonconductive housing and an internal metal element. The branch portion and widening portion of the first radiation element are disposed on the nonconductive housing of the accessory element.

In some embodiments, the accessory element is a speaker module, a camera module, a scanner module, or a USB (Universal Serial Bus) socket module.

In some embodiments, the antenna structure covers a first frequency band from 699 MHz to 960 MHz, a second frequency band from 1400 MHz to 2170 MHz, and a third frequency band from 2300 MHz to 2700 MHz.

In some embodiments, a coupling effect is induced between the first radiation element and the internal metal element of the accessory element, such that the radiation efficiency of the antenna structure is significantly increased within the first frequency band.

In some embodiments, the feeding radiation element substantially has a Z-shape.

In some embodiments, the feeding radiation element has a first end and a second end. The feeding point is positioned at the first end of the feeding radiation element.

In some embodiments, the first radiation element is a 3D (Three-Dimensional) meandering structure.

In some embodiments, the first radiation element has a first end and a second end. The first end of the first radiation element is coupled to the second end of the feeding radiation element. A grounding point coupled to the ground voltage is positioned at the second end of the first radiation element.

In some embodiments, the branch portion of the first radiation element substantially has a U-shape.

In some embodiments, the widening portion of the first radiation element substantially has a pentagonal shape.

In some embodiments, the total length of the feeding radiation element and the first radiation element is shorter than or equal to 0.5 wavelength of the first frequency band.

In some embodiments, the second radiation element substantially has a straight-line shape.

In some embodiments, the second radiation element is at least partially parallel to the first radiation element.

In some embodiments, the second radiation element has a first end and a second end. The first end of the second radiation element is coupled to the second end of the feeding radiation element. The second end of the second radiation element is an open end.

In some embodiments, the total length of the feeding radiation element and the second radiation element is longer than or equal to 0.25 wavelength of the third frequency band.

In some embodiments, the antenna structure further includes a switch element, a first impedance element, a second impedance element, and a third impedance element. The switch element selects one of the first impedance element, the second impedance element, and the third impedance element according to a control signal, such that the grounding point is coupled through the selected impedance element to the ground voltage.

In some embodiments, the first impedance element, the second impedance element, and the third impedance element have different impedance values.

In some embodiments, the first impedance element is an inductor

In some embodiments, the second impedance element is a short-circuited path.

In some embodiments, the third impedance element is a capacitor.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
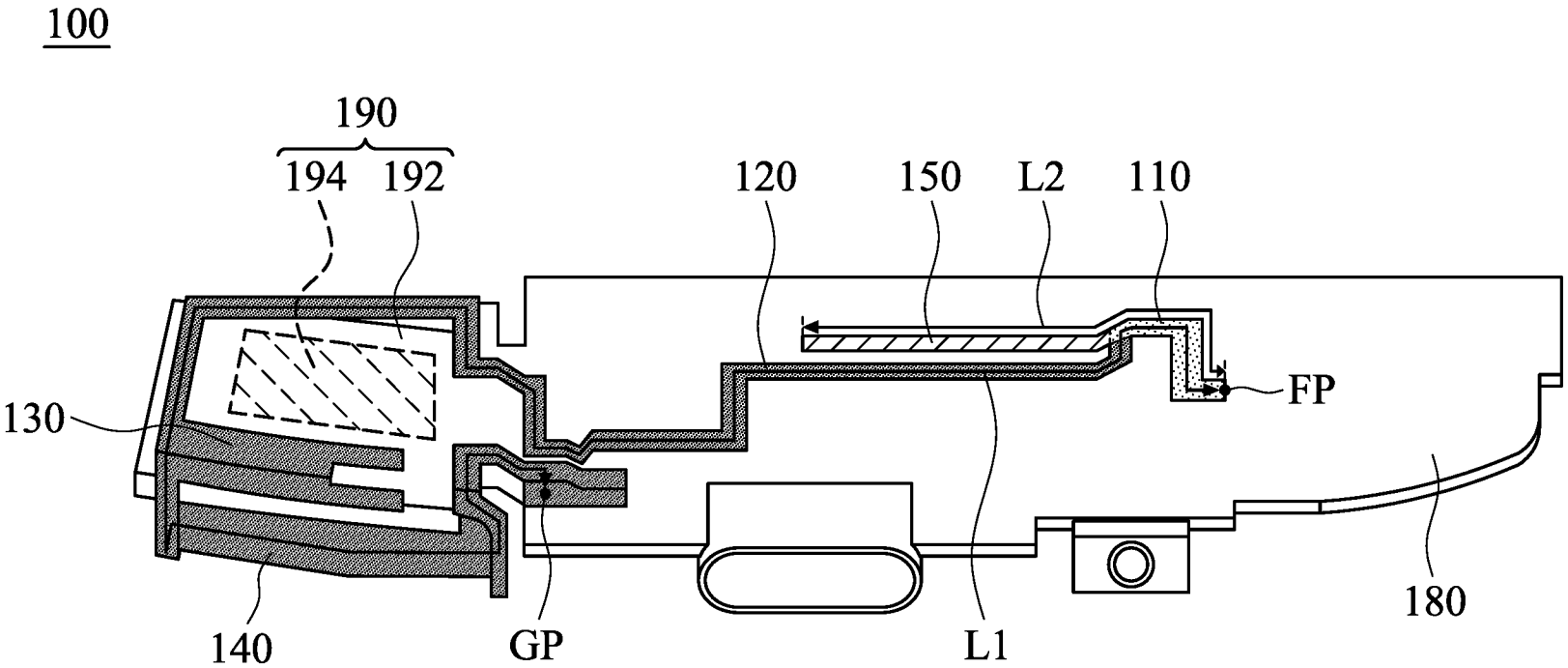
FIG. 1 is a perspective view of an antenna structure according to an embodiment of the invention.

In order to illustrate the foregoing and other purposes, features and advantages of the invention, the embodiments and figures of the invention are described in detail below.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Figure 2:
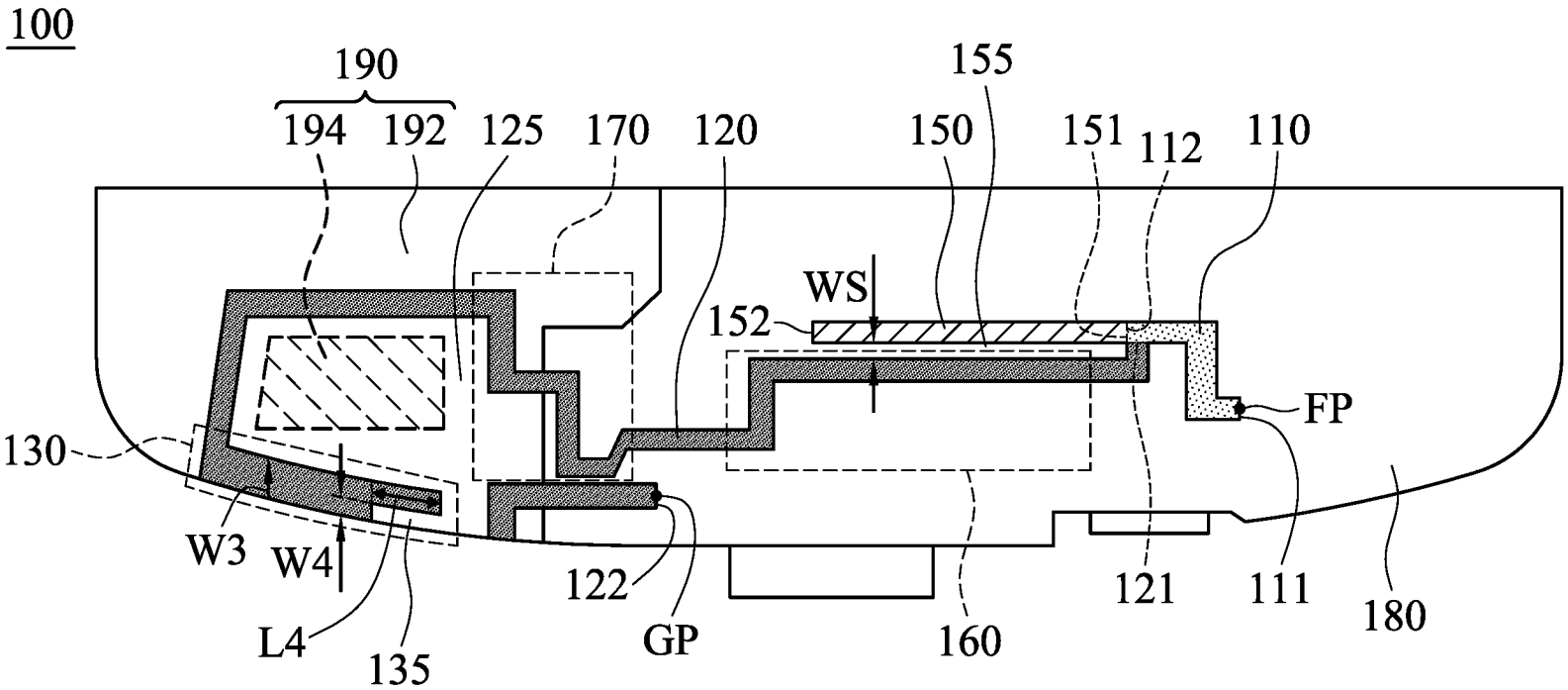
FIG. 2 is a top view of an antenna structure according to an embodiment of the invention.
Figure 3:
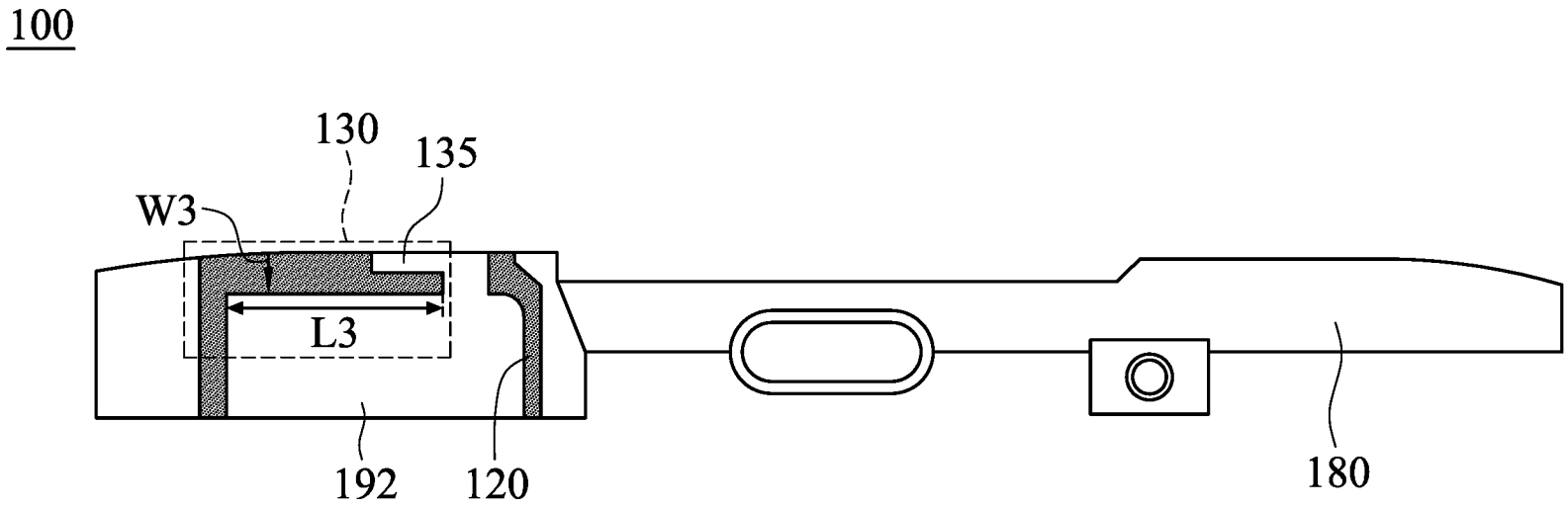
FIG. 3 is a side view of an antenna structure according to an embodiment of the invention.
Figure 4:
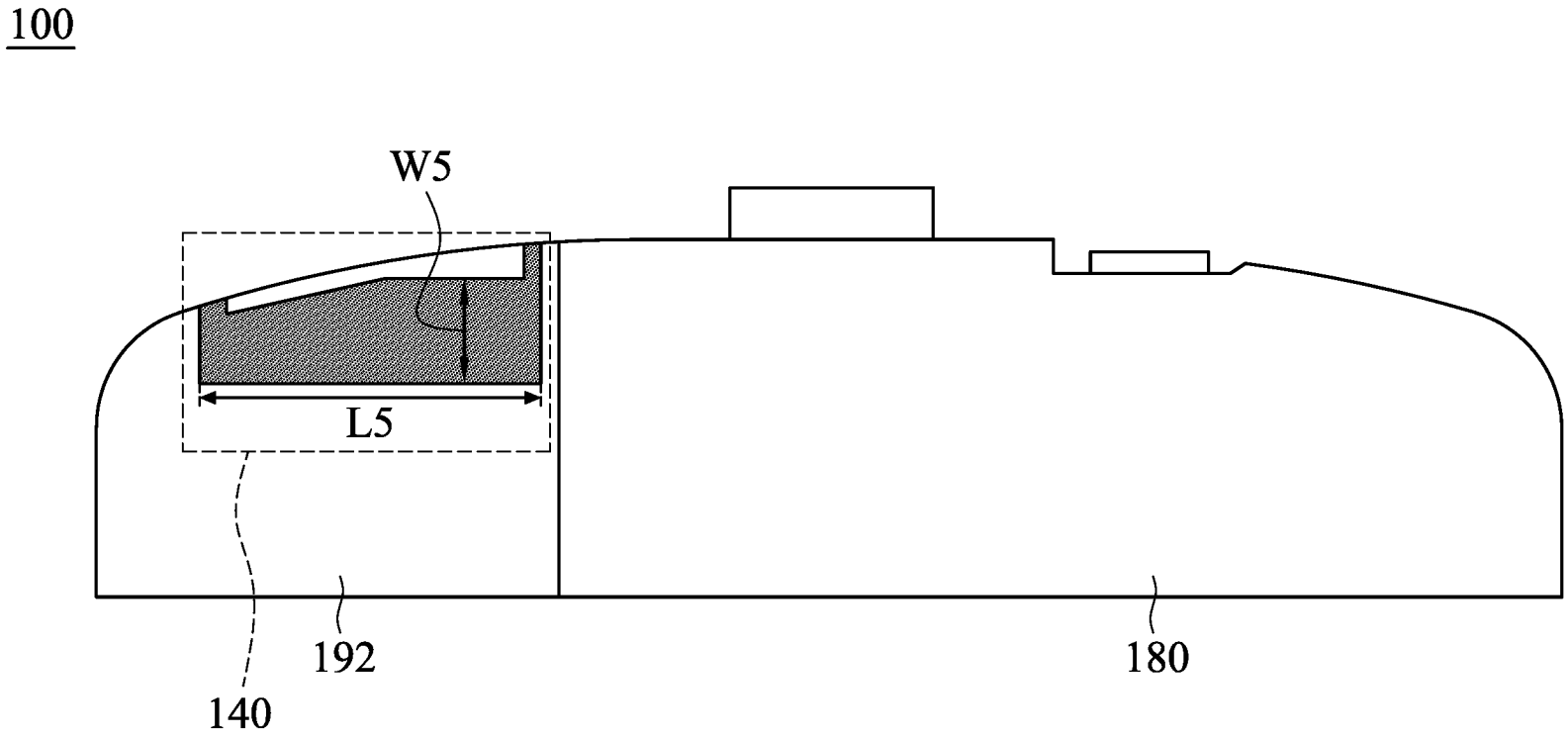
FIG. 4 is a back view of an antenna structure according to an embodiment of the invention.

FIG. 1 is a perspective view of an antenna structure 100 according to an embodiment of the invention. FIG. 2 is a top view of the antenna structure 100 according to an embodiment of the invention. FIG. 3 is a side view of the antenna structure 100 according to an embodiment of the invention. FIG. 4 is a back view of the antenna structure 100 according to an embodiment of the invention. Please refer to FIGS. 1-4 together. The antenna structure 100 may be applied to a mobile device, such as a smartphone, a tablet computer, or a notebook computer. As shown in FIGS. 1-4, the antenna structure 100 includes a feeding radiation element 110, a first radiation element 120, a second radiation element 150, a nonconductive support element 180, and an accessory element 190. The feeding radiation element 110, the first radiation element 120, and the second radiation element 150 may all be made of metal materials, such as copper, silver, aluminum, iron, or their alloys.

The feeding radiation element 110 may substantially have a Z-shape or an N-shape. Specifically, the feeding radiation element 110 has a first end 111 and a second end 112. A feeding point FP is positioned at the first end 111 of the feeding radiation element 110. The feeding point FP may be further coupled to a signal source (not shown). For example, the aforementioned signal source may be an RF (Radio Frequency) module for exciting the antenna structure 100.

The first radiation element 120 may be substantially a 3D (Three-Dimensional) meandering structure. Specifically, the first radiation element 120 has a first end 121 and a second end 122. The first end 121 of the first radiation element 120 is coupled to the second end 112 of the feeding radiation element 110. A grounding point GP coupled to a ground voltage VSS is positioned at the second end 122 of the first radiation element 120. That is, the feeding radiation element 110 is coupled through the first radiation element 120 to the ground voltage VSS. The ground voltage VSS is provided by a system ground plane (not shown) of the antenna structure 100.

The first radiation element 120 at least includes a branch portion 130 and a widening portion 140. The branch portion 130 of the first radiation element 120 may substantially have a U-shape. In some embodiments, the branch portion 130 of the first radiation element 120 has a notch region 135, which may substantially have a straight-line shape. The widening portion 140 of the first radiation element 120 may substantially have a pentagonal shape, whose width is much greater than that of the other portion of the first radiation element 120. In addition, the aforementioned pentagonal shape has at least two opposite sides which are parallel to each other. In some embodiments, the first radiation element 120 surrounds a semi-enclosed region 125. The branch portion 130 and the widening portion 140 of the first radiation element 120 are both adjacent to the semi-enclosed region 125. It should be noted that the term "adjacent" or "close" over the disclosure means that the distance (spacing) between two corresponding elements is smaller than a predetermined distance (e.g., 5 mm or shorter), or means that the two corresponding elements directly touch each other (i.e., the aforementioned distance/spacing therebetween is reduced to 0).

In some embodiments, the first radiation element 120 further includes a first bending portion 160 and a second bending portion 170. For example, the first bending portion 160 of the first radiation element 120 may substantially have an L-shape, and the second bending portion 170 of the first radiation element 120 may substantially have a W-shape, but they are not limited thereto. In some embodiments, the feeding radiation element 110 is coupled to the grounding point GP through the first bending portion 160, the second bending portion 170, the branch portion 130, and the widening portion 140 of the first radiation element 120, in that order. It should be understood that the first bending portion 160 and the second bending portion 170 of the first radiation element 120 are optional, and their shape can be adjusted in order to meet different requirements.

The second radiation element 150 may substantially have a straight-line shape, which is at least partially parallel to the first radiation element 120. Specifically, the second radiation element 150 has a first end 151 and a second end 152. The first end 151 of the second radiation element 150 is coupled to the second end 112 of the feeding radiation element 110 and the first end 121 of the first radiation element 120. The second end 152 of the second radiation element 150 is an open end, which extends away from the feeding radiation element 110. In some embodiments, a slot region 155 is formed between the first radiation element 120 and the second radiation element 150. For example, the slot region 155 with an open end and a closed end may substantially have a straight-line shape.

The nonconductive support element 180 is arranged for at least partially carrying the feeding radiation element 110, the first radiation element 120, and the second radiation element 150. In some embodiments, the feeding radiation element 110, the first radiation element 120, and the second radiation element 150 are all disposed on a FPC (Flexible Printed Circuit Board) (not shown), and the FPC is attached to the nonconductive support element 180.

The accessory element 190 may be another module whose function is different from that of the antenna structure 100. For example, the accessory element 190 may be a speaker module, a camera module, a scanner module, or a USB (Universal Serial Bus) socket module, but it is not limited thereto. Specifically, the accessory element 190 includes a nonconductive housing 192 and an internal metal element 194. The branch portion 130 and the widening portion 140 of the first radiation element 120 are both disposed on the nonconductive housing 192 of the accessory element 190. In some embodiments, the aforementioned FPC is further attached to the nonconductive housing 192 of the accessory element 190.

Figure 5:
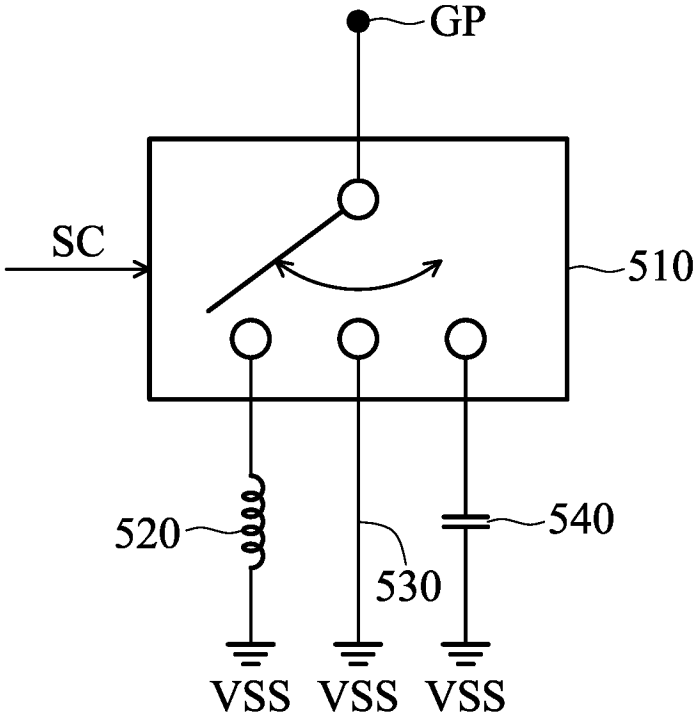
FIG. 5 is a diagram of a frequency adjustment mechanism of an antenna structure according to an embodiment of the invention.

FIG. 5 is a diagram of a frequency adjustment mechanism of the antenna structure 100 according to an embodiment of the invention. In the embodiment of FIG. 5, the antenna structure 100 further includes a switch element 510, a first impedance element 520, a second impedance element 530, and a third impedance element 540. The switch element 510 has a first terminal and a second terminal. The first terminal of the switch element 510 is coupled to the grounding point GP. The second terminal of the switch element 510 is switchable between the first impedance element 520, the second impedance element 530, and the third impedance element 540. The first impedance element 520, the second impedance element 530, and the third impedance element 540 have different impedance values. For example, the first impedance element 520 may be a fixed inductor or a variable inductor, the second impedance element 530 may be a short-circuited path, and the third impedance element 540 may be a fixed capacitor or a variable capacitor, but they are not limited thereto. The switch element 510 selects the first impedance element 520, the second impedance element 530, or the third impedance element 540, depending on the control signal SC, so that the grounding point GP may be coupled to the ground voltage VSS through the selected impedance element. For example, the aforementioned control signal SC may be generated by a processor (not shown) according to a user input. In alternative embodiments, the switch element 510 is replaced with three independent sub-switch elements, which are respectively coupled to the first impedance element 520, the second impedance element 530, and the third impedance element 540, without affecting the performance of the invention. It should be understood that the switch element 510, the first impedance element 520, the second impedance element 530, and the third impedance element 540 are optional elements, and they are replaced with a direct grounding path in other embodiments.

Figure 6:
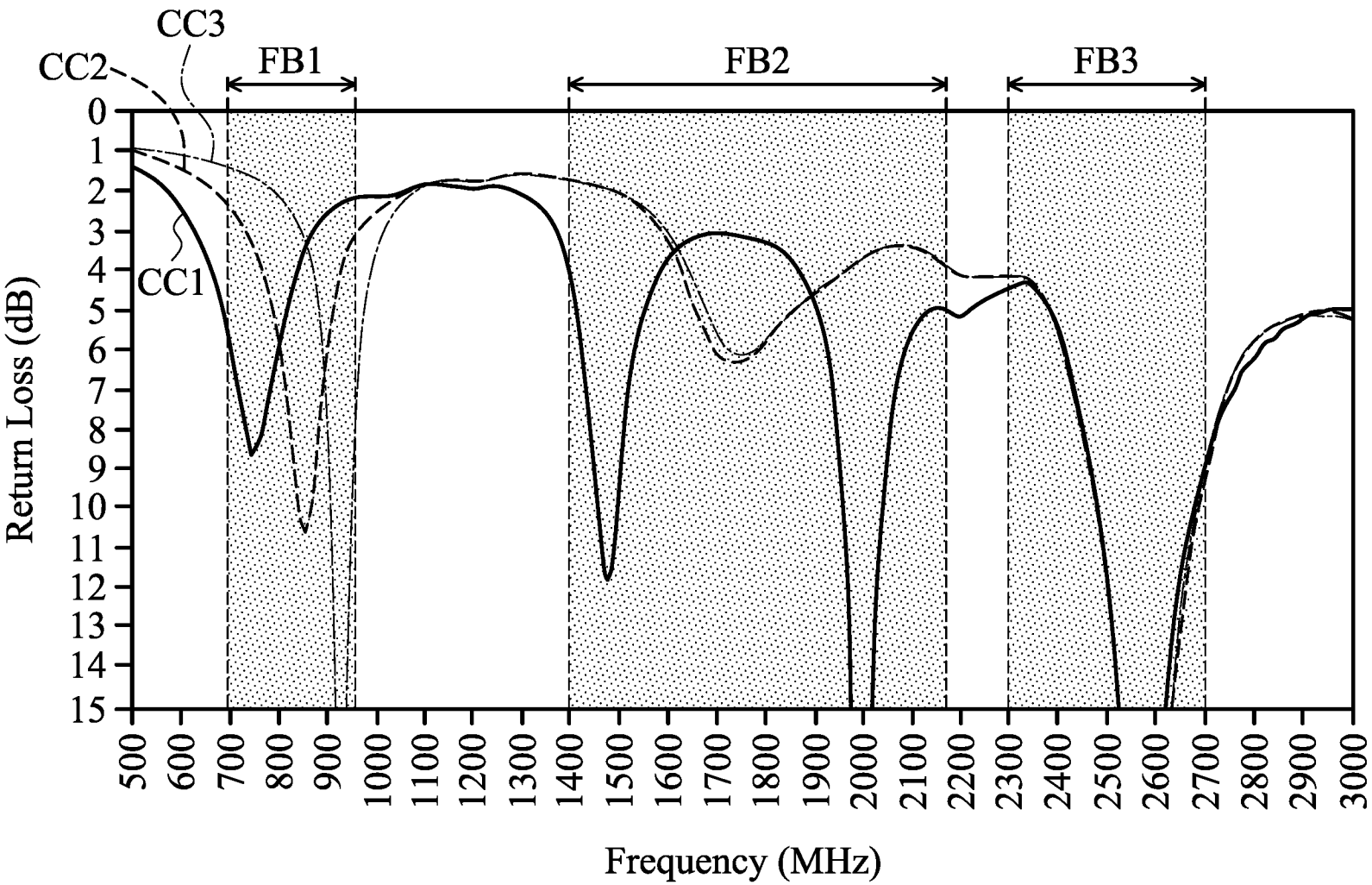
FIG. 6 is a diagram of return loss of an antenna structure according to an embodiment of the invention.

FIG. 6 is a diagram of return loss of the antenna structure 100 according to an embodiment of the invention. The horizontal axis represents the operation frequency (MHz), and the vertical axis represents the return loss (dB). A first curve CC1 represents the operation characteristic of the antenna structure 100 when the switch element 510 selects the first impedance element 520. A second curve CC2 represents the operation characteristic of the antenna structure 100 when the switch element 510 selects the second impedance element 530. A third curve CC3 represents the operation characteristic of the antenna structure 100 when the switch element 510 selects the third impedance element 540. According to the measurement of FIG. 6, the antenna structure 100 can cover a first frequency band FB1, a second frequency band FB2, and a third frequency band FB3. For example, the first frequency band FB1 may be from 699 MHz to 960 MHz, the second frequency band FB2 may be from 1400 MHz to 2170 MHz, and the third frequency band FB3 may be from 2300 MHz 2700 MHz. Accordingly, the antenna structure 100 can support at least the wideband operations of LTE (Long Term Evolution).

With respect to the antenna theory, the feeding radiation element 110 and the first radiation element 120 are excited to generate a fundamental resonant mode, thereby forming the aforementioned first frequency band FB1. Furthermore, the feeding radiation element 110 and the first radiation element 120 are excited to generate a higher-order resonant mode, thereby forming the aforementioned second frequency band FB2. In addition, the feeding radiation element 110 and the second radiation element 150 are excited to generate the aforementioned third frequency band FB3. It should be noted that since the branch portion 130 and the widening portion 140 of the first radiation element 120 are adjacent to the accessory element 190, a coupling effect is induced between the first radiation element 120 and the internal metal element 194 of the accessory element 190. According to practical measurements, with such a design, the radiation efficiency of the antenna structure 100 is significantly increased within the first frequency band FB1.

Figure 7:
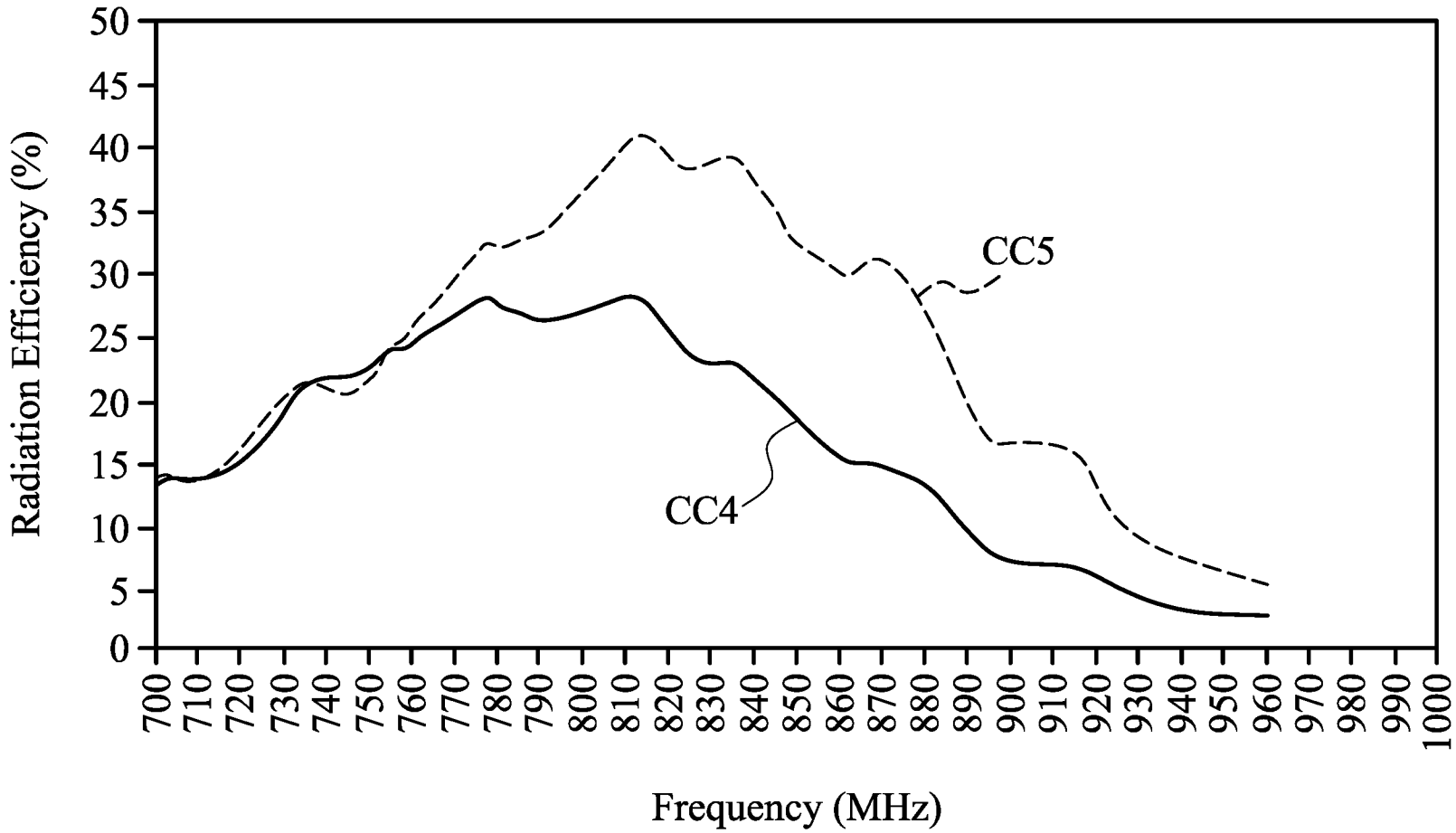
FIG. 7 is a diagram of radiation efficiency of an antenna structure according to an embodiment of the invention.

FIG. 7 is a diagram of radiation efficiency of the antenna structure 100 according to an embodiment of the invention. The horizontal axis represents the operation frequency (MHz), and the vertical axis represents the radiation efficiency (%). A fourth curve CC4 represents the operation characteristic of the antenna structure 100 when the first radiation element 120 is not adjacent to the accessory element 190 (no coupling effect). A fifth curve CC5 represents the operation characteristic of the antenna structure 100 when the first radiation element 120 is adjacent to the accessory element 190 (as the proposed design of the invention, there is a coupling effect induced between the first radiation element 120 and the internal metal element 194 of the accessory element 190). According to the measurement of FIG. 7, because the internal metal element 194 of the accessory element 190 is considered as an extension radiation element of the antenna structure 100, the radiation efficiency of the antenna structure 100 can be effectively increased by about 13% within the first frequency band FB1, and it can meet the requirement of practical application of general mobile communication devices.

In some embodiments, the element sizes and element parameters of the antenna structure 100 are described as follows. The total length L1 of the feeding radiation element 110 and the first radiation element 120 may be shorter than or equal to 0.5 wavelength ($\lambda/2$) of the first frequency band FB1 of the antenna structure 100. The total length L2 of the feeding radiation element 110 and the second radiation element 150 may be longer than or equal to 0.25 wavelength (λ/4) of the third frequency band FB3 of the antenna structure 100. In the first radiation element 120, the length L3 of the branch portion 130 may be from 8 mm to 12 mm, and the width W3 of the branch portion 130 may be from 3 mm to 4 mm. The length L4 of the notch region 135 may be from 4 mm to 6 mm, and the width W4 of the notch region 135 may be from 1 mm to 2 mm. In the first radiation element 120, the length L5 of the widening portion 140 may be from 12 mm to 16 mm, and the width W5 of the widening portion 140 may be from 4 mm to 6 mm. The width WS of the slot region 155 may be from 0.5 mm to 1 mm. The inductance of the first impedance element 520 may be from 8 nH to 12 nH. The resistance of the second impedance element 530 may be substantially equal to 0Ω. The capacitance of the third impedance element 540 may be from 2 pF to 6 pF. The above ranges of element sizes and element parameters are calculated and obtained according to many experiment results, and they help to optimize the operation bandwidth and impedance matching of the antenna structure 100.

The invention proposes a novel antenna structure including an accessory element. Since there is a coupling effect induced between the accessory element and a radiation element of the antenna structure, the radiation efficiency of the antenna structure is effectively improved. In comparison to the conventional design, the invention has at least the advantages of small size, wide bandwidth, low manufacturing cost, and adapting to different environments, and therefore it is suitable for application in a variety of mobile communication devices.

Note that the above element sizes, element shapes, and frequency ranges are not limitations of the invention. An antenna designer can fine-tune these settings or values according to different requirements. It should be understood that the antenna structure of the invention is not limited to the configurations of FIGS. 1-7. The invention may include any one or more features of any one or more embodiments of FIGS. 1-7. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with the true scope of the disclosed embodiments being indicated by the following claims and their equivalents.

What is claimed is:

1. An antenna structure, comprising:

a feeding radiation element, having a feeding point;

a first radiation element, comprising a branch portion and a widening portion, wherein the feeding radiation element is coupled through the first radiation element to a ground voltage;

a second radiation element, coupled to the feeding radiation element and the first radiation element;

a nonconductive support element, carrying the feeding radiation element, the first radiation element, and the second radiation element; and an accessory element, comprising a nonconductive housing and an internal metal element, wherein the branch portion and the widening portion of the first radiation element are disposed on the nonconductive housing of the accessory element.

2. The antenna structure as claimed in claim 1, wherein the accessory element is a speaker module, a camera module, a scanner module, or a USB (Universal Serial Bus) socket module.

3. The antenna structure as claimed in claim 1, wherein the antenna structure covers a first frequency band from 699 MHz to 960 MHz, a second frequency band from 1400 MHz to 2170 MHz, and a third frequency band from 2300 MHz to 2700 MHz.

4. The antenna structure as claimed in claim 3, wherein a coupling effect is induced between the first radiation element and the internal metal element of the accessory element, such that radiation efficiency of the antenna structure is significantly increased within the first frequency band.

5. The antenna structure as claimed in claim 1, wherein the feeding radiation element substantially has a Z-shape.

6. The antenna structure as claimed in claim 1, wherein the feeding radiation element has a first end and a second end, and the feeding point is positioned at the first end of the feeding radiation element.

7. The antenna structure as claimed in claim 1, wherein the first radiation element is a 3D (Three-Dimensional) meandering structure.

8. The antenna structure as claimed in claim 6, wherein the first radiation element has a first end and a second end, the first end of the first radiation element is coupled to the second end of the feeding radiation element, and a grounding point coupled to the ground voltage is positioned at the second end of the first radiation element.

9. The antenna structure as claimed in claim 1, wherein the branch portion of the first radiation element substantially has a U-shape.

10. The antenna structure as claimed in claim 1, wherein the widening portion of the first radiation element substantially has a pentagonal shape.

11. The antenna structure as claimed in claim 3, wherein a total length of the feeding radiation element and the first radiation element is shorter than or equal to 0.5 wavelength of the first frequency band.

12. The antenna structure as claimed in claim 1, wherein the second radiation element substantially has a straight-line shape.

13. The antenna structure as claimed in claim 1, wherein the second radiation element is at least partially parallel to the first radiation element.

14. The antenna structure as claimed in claim 6, wherein the second radiation element has a first end and a second end, the first end of the second radiation element is coupled to the second end of the feeding radiation element, and the second end of the second radiation element is an open end.

15. The antenna structure as claimed in claim 3, wherein a total length of the feeding radiation element and the second radiation element is longer than or equal to 0.25 wavelength of the third frequency band.

16. The antenna structure as claimed in claim 8, further comprising:

a switch element;

a first impedance element;

a second impedance element; and a third impedance element, wherein the switch element selects one of the first impedance element, the second impedance element, and the third impedance element according to a control signal, such that the grounding point is coupled through the selected impedance element to the ground voltage.

17. The antenna structure as claimed in claim 16, wherein the first impedance element, the second impedance element, and the third impedance element have different impedance values.

18. The antenna structure as claimed in claim 16, wherein the first impedance element is an inductor.

19. The antenna structure as claimed in claim 16, wherein the second impedance element is a short-circuited path.

20. The antenna structure as claimed in claim 16, wherein the third impedance element is a capacitor.

* * * * *